United States Patent [19]

Nelissen et al.

[11] 4,420,506

[45] Dec. 13, 1983

[54] METHOD OF MANUFACTURING AN ARTICLE OF A SYNTHETIC RESIN WHICH HAS A METAL LAYER

[75] Inventors: Johan W. A. Nelissen; Johannes J. Ponjee; Petrus E. J. Legierse; Johannes Van Ruler, all of Eindhoven, Netherlands

[73] Assignee: U.S. Philips Corporation, New York, N.Y.

[21] Appl. No.: 419,350

[22] Filed: Sep. 17, 1982

Related U.S. Application Data

[63] Continuation-in-part of Ser. No. 338,708, Jan. 11, 1982, abandoned.

[30] Foreign Application Priority Data

Jul. 16, 1981 [NL] Netherlands ..... 8103375

[51] Int. Cl.[3] ..... B05D 1/38; B05D 3/10

[52] U.S. Cl. ..... 427/162; 427/145; 427/164; 427/405; 204/19; 204/380

[58] Field of Search ..... 427/541, 145, 162, 164, 427/405; 204/19, 380

[56] References Cited

U.S. PATENT DOCUMENTS 4,124,672 11/1978 Jarsen ..... 427/164 X

*Primary Examiner*—James R. Hoffman

*Attorney, Agent, or Firm*—Norman N. Spain

[57] ABSTRACT

Method of manufacturing an article of synthetic resin which has an electroless provided metal layer in which a mixture of monomeric acrylates and an N-substituted pyrrolidon compound is polymerized, the resulting article is treated with an aromic carboxylic acid substituted with one or more hydroxy groups and/or an amino group, or derivatives thereof, and a metal layer is then provided on the thus treated article by electroless deposition.

6 Claims, No Drawings

METHOD OF MANUFACTURING AN ARTICLE OF A SYNTHETIC RESIN WHICH HAS A METAL LAYER

This application is a continuation-in-part of application Ser. No. 338,708 filed Jan. 11, 1982, now abandoned.

BACKGROUND OF THE INVENTION

The invention relates to a method of manufacturing an article of a synthetic resin which on at least a part of its surface has a metal layer provided by electroless deposition.

According to a conventional electroless metallization process, the surface of the article to be metallized is treated with an aqueous ammoniacal silver salt solution, and is then, or simultaneously, treated with a reduction agent for the metal salt used, as a result metal atoms depositing on the surface of the article to be covered.

An interesting method of electroless metallization is the so-called aerosol metallization in which the metal salt solution and the reduction agent are atomized simultaneously on the surface of the article to be metallized. For further details of this method reference may be made to "The Technology of Aerosol Plating" by Donald J. Levy in Technical Proceedings 51st Annual Convention American Electroplaters' Society, 14–18 June, St. Louis, 1964, pp. 139–149.

It is stated on page 141, left column of this literature reference that upon metallizing synthetic resins, the non-polar weakly-polar surface of the resin must first be treated chemically or electrically and then be sensitized with a reduction agent, such as $SnCl_2$. The reduction agent initiates and accelerates the deposition of metal atoms, a first monolayer of deposited metal being formed. Various chemical treating agents are recorded in Table II on page 140 of the above-mentioned literature reference.

The chemical pretreatment of products of synthetic resin so as to make them better suitable for providing a metal mirror has been given much attention in literature.

Published Netherlands patent application No. 74.10.125, for example, states that polyamide resins are pretreated with a swelling agent which is also a reduction agent.

According to French Patent Specification No. 1.328.032 the surface of, for example, a polystyrene synthetic resin is treated with a sulphonating or hydroxylating agent or with polyphenols or aminophenols.

German Offenlegungsschrift No. 2,755,374 states that the surface of the synthetic resin is provided with a special adhering or top layer which comprises a hydrophilic synthetic resin mixture.

According to published Netherlands patent application No. 68.16.061 the synthetic resin to be metallized, such as an ABS (Acrylonitrile-Butadiene—Styrene) synthetic resin must comprise a basic nitrogen-containing polymer, in particular polyvinylpyridine. Finally, reference is made to U.S. Pat. No. 3,094,430 in which it is stated that upon silverplating acrylic synthetic resins the surface is pretreated with tannine acid. A sensitisation treatment with $SnCl_2$ is not used in this method.

However, the adhesion of an electroless plated metal layer on non-polar or weakly polar synthetic resins remains troublesome. In the first-mentioned literature reference "The technology of aerosol plating" it is stated in this respect on page 141 left column, that the chemical forces between metal layer and synthetic resin surface are usually very weak and that a considerable improvement of the adhesion occurs when the synthetic resin surface is roughened.

It is the object of the invention to manufacture an article of synthetic resin having an electroless plated metal layer in which the metal layer adheres excellently to the surface of the article and in which the said surface is not etched and in particular is not roughened.

SUMMARY OF THE INVENTION

According to the invention this object is achieved by an electroless metal plating method in which a polymerizable monomer composition comprising monomeric acrylates as well as a polymerizable N-substituted pyrrolidion compound, is polymerized, the resulting synthetic resin article is treated with an aromatic carboxylic acid which is substituted in the nucleus with one or more hydroxy groups and/or or glucose derivatives thereof, and the treated article is provided by electroless deposition with a metal layer on which, if desired, a further metal layer may be provided.

Preferably the synthetic resin is treated with a mono di- or trihydroxybenzoic acid or a glucose derivative of these acids.

The resultant adhesion of the metal layer to the article of synthetic resin has been found to be excellent.

This surprisingly good adhesion is caused, as has been established from experiments and analytical investigation, by the formation of a stable and strong complex between the pyrrolidon compound and the carboxylic acid or derivative thereof used. This complex is believed based on the formation of hydrogen bridges between the keto group of the pyrrolidon compound and a hydroxyl group of the carboxylic acid or derivative.

The surface, or rather the surface layer, of the article of synthetic resin obtained after polymerization is not etched during the treatment with the carboxylic acid or the derivative following the polymerization and the subsequent metallization. In this manner, not only the structure or texture of the surface in question is entirely maintained, a change, i.e. a deterioration of the optical quality of the surface layer of the article of synthetic resin does not occur either. Further no cloudiness occurs in the surface layer of a transparent acrylate article.

An example of an N-substituted pyrrolidon compound is N-acrylpyrrolidon. However because of its high availability and relative low price N-vinylpyrrolidon is preferred.

The quantity by weight of the pyrrolidon compound in the polymerizable monomer composition is not restricted to narrow limits. A quantity from 1 to 30% by weight, and in particular 10–20% by weight, is to be preferred.

The acrylates used in the method according to the invention are the usual, commercially available monomers which after polymerization provide the so-called acrylic resin. Examples of acrylate monomers are alkyl acrylates, such as ethyl hexyl acrylate, alkanediol diacrylates, such as hexanediol diacrylate, alkeneglycol diacrylates, such as tripropylene glycol diacrylate and triacrylates, such as ethyoxylated or non-ethoxylated trimethylolpropane triacrylate (Where hardness is of importance best results are achieved by not employing the monoacrylate by themselves and pentaerythritolpropane triacrylate).

The polymerization of the mixture of acrylates and the pyrrolidon compound occurs in the usual manner by using thermal energy (thermo-curing) or by using light such as U.V.-light (U.V.-curing). Light-curing requires a photo-sensitive catalyst such as a ketal, for example, benzyldimethylketal. The quantity of catalyst in the polymerizable mixture is approximately 1–5% by weight.

In a preferred embodiment of the method in accordance with the invention the article of synthetic resin is treated with di- or trihydroxy benzoic acid or a derivative thereof.

Examples of readily useful hydroxybenzoic acids are gallic acid, digallic acid or digalloylgallic acid. Good results are obtained with the substance tannin, also termed tannic acid, a pentadigalloylglucole compound.

The hydroxy substituted acids and their derivatives are used in the form of aqueous solutions of which the acidity varies from aromatic approximately 1.5 to 6 in accordance with the type of substance used and the concentration thereof. The acidity may be adjusted at different values by the addition of bases or acids, but it must preferably be lower than 7. The concentration of the substance in the aqueous solution may vary between wide limits and is, for example, from 0.01 to 10 g per liter. The use of an aqueous solution of tannin with a minimum quantity of tannin of 0.001 g per liter of solution is preferred. Even with this very small quantity of tannin, excellent results are still obtained.

The treatment of the synthetic resin article obtained after polymerization of the monomer composition, with the said aqueous solution may be carried out in various known manners, for example, by immersing the article in the solution or by spraying or atomizing the aqueous solution on the surface to be metallized. The treatment time is a few seconds to at most a few minutes.

The article of synthetic resin treated with the above-mentioned aqueous solution is then provided with a metal layer, for example, an Ag-layer, according to a known electrochemical process.

For this purpose, first of all the surface to be metallized is treated with a sensitizing solution. In the case the metal layer is of an Ag-layer, a sensitizing solution is used is an aqueous, acid-reacting $SnCl_2$ solution. The surface to be metallized may be dipped in the $SnCl_2$ solution or be sprayed with the $SnCl_2$ solution. The treatment time is a few seconds to at most one minute. It has been found that in the process according to the invention an $SnCl_2$ solution may be used which comprises a very small quantity of $SnCl_2$ of 0.001 g per liter. The excess of the $SnCl_2$ solution is removed by rinsing with water.

The surface to be metallized is then treated with the actual metallization solutions comprising the aqueous metal salt solution, such as an ammoniacal silver nitrate solution and an aqueous reduction agent solution.

A suitable reduction agent is, for example, formaldehyde, if desired in combination with a sugar, such as sodium gluconate.

Examples of other useful reduction agents are hydrazine sulphate, hydroxyethyl hydrazine, glyoxal and triethanolamine. The metallization solutions are preferably provided according to the already mentioned aerosol metallization process in which the metal salt solution and the reduction agent solution are atomized simultaneously on the surface to be metallized. It is to be noted that the acidity of the combined metal salt solution and the reduction agent solution is preferably lower than 10 because at a pH>10 the danger exists that the formed complex of the pyrrolidon compound with the carboxylic acid, which complex is essential for the resulting good adhesion of the metal layer, is broken down.

The resultant electroless metal layer such as an Ag-layer, may be provided with a further metal layer by means of a galanic process, i.e. electrolytically. For example, the thickness of an electroless provided silver layer can be increased, and hence the strength of the layer, by providing hereon additional Ag-layers or, if desired a layer of another metal such as copper.

The additional metal layer, for example, a copper layer, may be provided electrolytically or by a galvanic process, for example, by depositing Cu on the electroless deposited silver layer, which serves as cathode, in an electrolysis bath comprising, for example, an acid copper sulphate solution. It is also possible to provide a copper layer by electroless deposition on the silver layer, for example, according to the above-mentioned aerosol metallization process in which an acid copper sulphate solution and a reduction agent, for example, an aqueous dispersion of Zn-dust, are simultaneously atomized over the silver layer.

A copper mirror can also be provided very readily as follows: the above-mentioned synthetic resin article treated with the carboxylic acid or a derivative thereof (tannin) is first sensitized with an acid-reacting $SnO_2$ solution. The sensitized surface is treated with an aqueous ammoniacal silver salt solution, in which the $Sn^{2+}$ ions present at the surface are exchanged against Ag which is formed according to the reaction $Sn^{2+}+2Ag^{+}\rightarrow 2Ag+Sn^{4+}$.

The resulting article which comprises a monolayer of Ag is then provided with a copper layer by using an ammoniacal cuprous salt solution and an acid. This process is known as the disproportioning process and is described inter alia in the above-mentioned literature reference Technical Proceedings 51st Annual Convention American Electroplaters' Society, p. 147, right-hand column, and in German Offenlegungsschrift No. 25.27.096.

The method according to the invention is particularly suitable for the manufacture of high-grade mirrors in which high requirements are imposed upon the reflection quality.

A very important field of application of the method in accordance with the invention is the manufacture of metallized articles of synthetic resin, in which a special structure or texture is present on the interface of synthetic resin and metal layer. This applies in particular to the manufacture of optically readable information disks, the so-called VLP (Video Long Play) and ALP (Audio Long Play) disks.

The disks are manufactured from synthetic resin and are provided on one or on both sides with an optical structure of information regions present alternately at a higher level and at a lower level. The regions have very small dimensions, the difference in level between high regions and low regions being from 0.1 to 0.2 μm and the longitudinal dimensions varying from approximately 0.3 to 3 μm in accordance with the stored information. The optical structure is covered with a metal layer, for example, an Ag-layer.

The structure is read in reflection by means of laser light. The laser light is preferably focused on the optical structure via the disk-shaped body of synthetic resin which must be transparent to laser light. The metal layer must follow the contours of the optical structure very accurately and remain firmly adhered on the substream of synthetic resin for many years. Upon providing the metal layer, the above-mentioned level difference of 0.1–0.2 μm may definitely not vary because this difference in level is decisive of the phase differences between forward and reflected laser light beam occurring during reading the disk, which differences are essential for a good reading c.q. playing back of the stored information.

Moreover, upon providing the metal layer, no cloudiness of the synthetic resin should occur in the boundary area synthetic resin metal layer boundary area. These requirements are fulfilled when the method according to the invention is used.

Thus a further aspect of the invention relates to a method of manufacturing a metallized optically readable information disk which is characterized in that a matrix which on one side has an optical structure of information areas situated alternately at a higher level and at a lower level is provided on the side of the optical structure with a liquid polymerizable monomer composition which composition comprises monomeric acrylates of the type already described as well as a polymerizable N-substituted pyrrolidon compound. After polymerization, the polymerized article in which the optical structure is copied is removed from the matrix, the article is then treated on the side of the optical structure with a mono-, di- or trihydroxybenzenecarboxylic acid or a glucose derivative thereof. The treated article is provided by electroless deposition with a metal layer on which, if desired a further metal layer may be provided. The monomer composition is cured (polymerized), for example, by exposure to ultraviolet light or by a temperature treatment.

A favourable embodiment of this process is characterized in that after the matrix has been provided with the polymerizable monomer composition, a transparent carrier plate is provided on the layer of monomer composition, the layer of monomer composition is cured, the cured layer in which the optical structure is copied together with the carrier plate bonded thereto, is removed from the matrix, and the resulting article is then treated and provided with a metal layer by means disclosed above.

The transparent carrier plate is preferable, for example, a transparent synthetic resin plate, such as a plate of polymethyl methacrylate, polypropylene, polycarbonate, polyvinyl chloride or, for example, glass. The layer of monomer composition is preferably cured, for example, by exposure to ultraviolet light via the transparent carrier plate.

DESCRIPTION OF THE PREFERRED EMBODIMENT

The invention will now be described in greater detail, by way of example, with reference to the following example.

EXAMPLE

Manufacture of a metallized optically readable information disk.

A 20 μm thick layer of a thin liquid, U.V. light-curable lacquer was provided on the surface of a nickel matrix having a spiral-like, optically readable information track having a crenellated profile of information areas situated alternately at a high level and at a lower level by means of, for example, a spraying or sprinkling process. The information areas of the matrix have small dimensions, the difference in height between the areas being 0.1−0.2 μm and the longitudinal dimensions varying from approximately 0.3 to 3 μm in accordance with the stored information.

The lacquer employed had the following composition:

10% by weight of tripropylene glycol diacrylate
71% by weight of trimethylol propane triacrylate
15% by weight of N-vinylpryrrolidon
4% by weight of benzildimethylketal (Photoinitiator)

A 1.2 mm thick carrier plate of polymethyl methacrylate was placed on the lacquer layer and the lacquer layer was then exposed for a few seconds, through the transparent carrier plate, to ultraviolet light originating from a high-pressure mercury lamp (type Philips HPM 12) with a power of 400 W.

After curing the lacquer layer, the carrier plate and the layer connected thereto in which the information cured lacquer track of the matrix was copied, was removed from the matrix.

The resulting information disk was then treated with a 0.3% solution of tannin in water. For this purpose the free surface cured lacquer layer bearing the information track was sprinkled for 10 seconds with the above-mentioned tannin solution. The information disk may alternatively be dipped in the tannin solution for 10 seconds.

The disc was rinsed with water after which the surface of the cured lacquer layer was suitable for sensitizing with an aqueous $SnCl_2$ solution. For this purpose the surface of the cured lacquer layer was sprinkled with, or the information disk was dipped in, an aqueous $SnCl_2$ solution which contains per liter 0.1 g of $SnCl_2$ and 0.1 ml of concentrated HCl. The treatment time was 12 seconds. The surface of the cured lacquer layer was then electrolessly silver-plated in the usual manner, preferably employing the aerosol (atomizing) process in which an aqueous silver salt solution such as a solution of $AgNO_3$ and $NH_4OH$ in water, and an aqueous reduction agent solution, such as a solution of formalin and if desired sodium gluconate in water, are simultaneously atomized on the surface. This process, as well as the metallization solutions and reduction agent solutions used therein, are described, for example, in the above-mentioned literature reference "The Technology of Aerosol Plating".

Various metallization chemicals are commercially available from, for example, Messrs. Ermax, London Laboratories Ltd., or Merck.

The adhesion of the thus electrolessly provided silver layer on the underlying polymerized lacquer layer was tested according to the so-called diamond scratching test (DIN 53151). According to this standard test, twelve scratches are made in the surface of the metal layer so as to extend over the hole thickness of the metal layer. The pattern of scratches comprises 6 parallel scratches with a mutual distance of 1 mm which are crossed at right angles by also 6 parallel scratches with a mutual distance of 1 mm so that the pattern of scratches comprises 25 areas of 1 $mm^2$. An adhesive strip (cellotape) is pressed on the pattern of scratches and is then pulled off the surface. The extent of adhesion is expressed in numerals 0–5, in which 0=optimum adhesion; 0 areas work loose
1=good adhesion; 1–5 areas work loose
2=reasonable adhesion; 6–10 areas work loose 3=insufficient adhesion; 11–15 areas work loose
4=poor adhesion; 16–20 areas work loose
5=no adhesion; 21–25 areas work loose.

The results of the diamond scratching test applied to the above-mentioned silver layer demonstrate an optimum adhesion; none of the areas was removed with the adhesive tape.

The above example was repeated except instead of the above-mentioned lacquer several other lacquers were used the composition of which is recorded in the table below. The further process variables are identical to those stated in the above example. The resulting metallized information disks have been tested according to the diamond test in which it was established that in all cases an optimum adhesion (numerical value 0) was obtained of the silver layer on the cured lacquer layer.

The adhesion of the silver layer to the cured lacquer layer was determined by means of the diamond scratching test.

The results demonstrate that the adhesion when gallic acid is used corresponds to those obtained when tannin is used. The average adhesion had a value of 0–1 according to the scratch test. The treatment with dihydroxybenzoic acid gave an average adhesion value of 0–2 according to the scratch test, while the adhesion was slightly less and on an average showed values of approximately 2 or higher when monohydroxy acid was used.

If no treatment takes place with a carboxylic acid or derivative thereof as defined in the preceding paragraphs and in the claims, no adhesion (numerical value 5 according to the diamond scratch test) is obtained. The same applies if the lacquer used comprises no pyrrolidon compound.

Table of lacquer compositions

| lacquer | ingredients of lacquer | | | | | | | | | | | | | |
|---|---|---|---|---|---|---|---|---|---|---|---|---|---|---|
| No. | TMPTA | TPGDA | HDDA | PPT | AA | M | A | VA | UA | EA | HPA | MDA | NVP | BDK |
| 1 | | | 16 | 64 | | | | | | | | | 16 | 4 |
| 2 | | | 14 | 54 | | | | | | | | | 28 | 4 |
| 3 | 10 | 57 | | | | | | | | | | | 29 | 4 |
| 4 | 10 | 66 | | | | | | | | | | | 20 | 4 |
| 5 | 10 | 76 | | | | | | | | | | | 10 | 4 |
| 6 | 10.5 | 59 | | | | | | | | | 15 | 1.5 | 10 | 4 |
| 7 | 5 | 76 | | | 2 | | | | | | | | 15 | 2 |
| 8 | 20 | 56 | | | 2 | 2 | | | | | | | 10 | 4 |
| 9 | 10 | 69 | | | | | 2 | | | | | | 10 | 4 |
| 10 | 10 | 71 | | | | | | | | | | | 15 | 4 |
| 11 | 10 | 66 | | | | | 5 | | | | | | 15 | 4 |
| 12 | 10 | 61 | | | | | 10 | | | | | | 15 | 4 |
| 13 | 10 | 61 | | | | | | 10 | | | | | 15 | 4 |
| 14 | 10 | 56 | | | | | | | 15 | | | | 15 | 4 |
| 15 | 10 | 69 | | | | | | | | 2 | | | 15 | 4 |
| 16 | 10 | 66 | | | | | | | | 5 | | | 15 | 4 |
| 17 | 11 | 63 | | | | | 2 | | | | | | 21 | 4 |
| 18 | 10 | 76 | | | | | | | | | | | 10 | 4 |
| 19 | 10 | 81 | | | | | | | | | | | 5 | 4 |
| 20 | 10 | 84 | | | | | | | | | | | 2 | 4 |
| 21 | 10 | 85 | | | | | | | | | | | 1 | 4 |
| 22 | 9.5 | 86 | | | | | | | | | | | 1.5 | 4 |
| 23 | | | 95 | | | | | | | | | | 1 | 4 |
| 24 | | | 94 | | | | | | | | | | 2 | 4 |
| 25 | | | 91 | | | | | | | | | | 5 | 4(C) |
| 26 | | | 86 | | | | | | | | | | 10 | 4 |
| 27 | | | 81 | | | | | | | | | | 15 | 4 |
| 28 | 17 | 45 | | | | | | | 17 | | | | 17 | 4 |
| 29 | 17 | 62 | | | | | | | | | | | 17 | 4 |

The abbreviations used in the table have the following meanings:
TMPTA = trimethylol propane triacrylate
TPGDA = tripropylene glycol diacrylate
HDDA = hexanedioldiacrylate
PPT = pentaerythritol-propyl ether triacrylate
AA = amino acrylate
M = maleic acid
A = acrylic acid
VA = vinyl acetate
UA = urethane acrylate
EA = epoxy acrylate
HPA = hydroxypropyl acrylate
MDA = methyldiethanol amine
NVP = N—vinylpyrrolidon
BDK = benzil dimethyl ketal (catalyst)

Further metallized information disks have been manufactured in a manner analogous to that described in the above example, with the modification that after curing the lacquer layer, the resulting information disk was not treated with an aqueous solution of tannin but with an aqueous solution of a hydroxy carboxylic acid, in particular a 0.3% aqueous solution of gallic acid, dihydroxybenzoic acid and monohydroxy benzoic acid.

The influence of the concentration of tannin in the aqueous tannin solution with respect to the adhesion of the silver layer to the cured lacquer layer is recorded in the following table. The composition of the lacquer is identical to that stated in the preceding example. In column 1 of Table II the tannin concentration is stated in grams per liter of solution. In column 2 the pH value of the solution is recorded. The adhesion stated in column 3 is determined according to the diamond scratch test in which the numerals have the above-mentioned meanings. The adhesion has been measured in three places of the information disk, namely the centre of the disk (C), the information-containing part of the disk (I) and the edge part of the disk (R).

TABLE II

| Concentration in g/l | pH | adhesion C | I | R |
|---|---|---|---|---|
| 30 | 3.25 | 0 | 0 | 0 |
| 10 | 3.47 | 0 | 0 | 0 |
| 3 | 3.53 | 0 | 0 | 0 |
| 1 | 3.85 | 0 | 0 | 0 |
| 0.3 | 4.31 | 0 | 0 | 0 |
| 0.1 | 4.60 | 0 | 0 | 0 |
| 0.01 | 5.25 | 0 | 0 | 0 |
| 0.003 | 5.49 | 0 | 0 | 0 |
| 0.001 | 5.57 | 0 | 0 | 0 |
| 0.0003 | 5.62 | 5 | 0 | 5 |
| 0 | — | 5 | 5 | 5 |

The above-described information disks having a silver layer, have been provided with a copper layer by simultaneously atomizing the following liquids at an atomizing pressure of 5 at. and for an atomizing period of 1 minute:

Liqud 1:
- 20 l water
- 50 g zinc dust
- 100 g dispersing agent (Ermax Suspens Concentrate)

Liquid 2:
- 20 l water
- 50 g $CnSO_4.5Aq$
- 40 g $H_2SO_4$ (96%)

The resulting disk with copper layer was rinsed in water for 0.5 min. and dried.

We claim:

1. A method of manufacturing a synthetic resin provided on at least a part of its surface with a metal layer comprising (A) polymerizing a monomer composition comprising monomeric acrylates and a polymerizable N-substituted pyrrolidon compound, (B) treating the resulting synthetic resin article with an aromatic carboxylic acid which in the nucleus is substituted with one or more hydroxy groups or glucose derivatives thereof, (C) providing the resultant treated article, by electroless deposition, with a metal layer.

2. A method as claimed in claim 1, characterized in that the monomer composition comprises N-vinylpyrrolidon in a weight percentage of 1–30%.

3. A method as claimed in claim 1, characterized in that the article of synthetic resin is treated with a di- or trihydroxybenzoic acid or a glucose derivative thereof.

4. A method as claimed in claim 3, characterized in that the article of synthetic resin is treated with an aqueous solution of tannin containing at least 0.001 g of tannin per liter of solution.

5. A method of manufacturing a metallized optically readable information disc comprising:

(a) providing a surface of a disc-shaped matrix having an optical structure of information areas situated alternatively at higher and lower levels with a polymerizable composition coating comprising monomeric acrylates at least one of which acrylates is a di- or triacrylate and a polymerizable N-substituted pyrrolidon compound, (b) polymerizing said polymerizable composition coating, (c) removing said resultant disc-shaped polymerized article, a surface of which bears said optical structure, from said matrix, (d) treating the surface of said polymerized article bearing said optical structure with an aromatic carboxylic acid substituted in the nucleus with at least one hydroxy group or glucose derivatives thereof and (e) providing, by electroless deposition, a metal layer on said resultant treated surface.

6. The method of claim 5 wherein, prior to polymerization, a transparent carrier plate is provided on the free surface of said polymerizable composition coating which carrier plate is capable of adhering to said disc-shaped polymerized article and subsequent to polymerization, the resultant optically readable information disc comprising the resultant laminate of said disc-shaped polymerized article and said supporting transparent carrier plate is removed from said matrix.

* * * * *